United States Patent [19]

Thomas

[11] Patent Number: 4,861,009

[45] Date of Patent: Aug. 29, 1989

[54] VARIABLE FORCE EXERTING CLAMP ASSEMBLY HAVING A VARIABLE CLAMPING AREA

[76] Inventor: Michael D. Thomas, 17 Pine Lake Dr., Arab, Ala. 35016

[21] Appl. No.: 160,290

[22] Filed: Feb. 25, 1988

[51] Int. Cl.[4] ..... B25B 1/20

[52] U.S. Cl. ..... 269/43; 269/131; 269/254 R

[58] Field of Search ..... 269/43, 41, 130–132, 269/254 R, 203, 204, 166, 167, 108; 254/29 A

[56] References Cited

U.S. PATENT DOCUMENTS

| | | | |
|---|---|---|---|
| 1,743,811 | 1/1930 | Eull et al. | 254/29 A |
| 1,751,823 | 3/1930 | Lampert | 254/29 A |
| 2,264,794 | 12/1941 | Gunderson | 254/29 A |
| 3,076,646 | 2/1963 | Harling | 269/131 |
| 3,186,704 | 6/1965 | McCloskey et al. | 269/254 |
| 4,572,491 | 2/1986 | Forrer | 269/131 |

*Primary Examiner*—Robert C. Watson

*Attorney, Agent, or Firm*—C. A. Phillips

[57] ABSTRACT

A variable force exerting clamp assembly having a variable clamping area. A stretchable strap which deforms or "thins" to a smaller width in response to stretching is provided with a first work-engaging clamp secured at one end thereof and a second movable clamp which is slidable between the ends of the strap. The clamps are disposed for engaging a workpiece or workpieces between each other, and tension is applied until the strap is stretched to exert the desired force on the members, whereby, upon release of the tensional force, the strap tends to assume its original configuration, and the second clamp exerts a clamping force on the strap responsive to the strap expanding to its original width.

15 Claims, 3 Drawing Sheets

VARIABLE FORCE EXERTING CLAMP ASSEMBLY HAVING A VARIABLE CLAMPING AREA

TECHNICAL FIELD

This invention relates generally to a clamp and more particularly to an elastic member having clamping elements thereon for gripped engagement of an assembly or element therebetween responsive to stretching of the elastic member.

BACKGROUND OF THE INVENTION

In the art of woodworking, it is sometimes necessary to clamp a pair of elements together for assembly thereof, such as by gluing, etc. Typically, the clamps are comprised of a pair of long bars joined by threaded shafts which must be rotated in threaded openings in the bars to adjust the distance between the bars. Such devices are usually very heavy or bulky in order to withstand the forces applied to them and also are usually very expensive because of the machining necessary to thread the shafts and openings. Additionally, large handles must also be machined and secured to the ends of the threaded shafts in order to rotate the shafts.

Other types of clamping devices are found in U.S. Pat. No. 4,042,264, issued Aug. 16, 1977, and U.S. Pat. No. 4,257584, issued Mar. 24, 1981, which include a long rigid bar or rod having a stationary member thereon and a slidable member which is slid or moved along the rod for engaging the workpiece between the stationary member and the movable member. Locking means in the form of a wedge which is forced between the rod and movable member is provided in one device (U.S. Pat. No. 4,042,264), and locking is provided in U.S. Pat. No. 4,257,584 by a threaded shaft rotatable by a ratchet wrench.

As can be seen, these devices are bulky and expensive to manufacture. Additionally, because of their bulky size, the devices can be of only limited use in confined areas. In contrast, applicant has provided a clamping assembly which is compact and not bulky while also being relatively inexpensive to manufacture. To this end, applicant's structure includes a stretchable flexible strap having a work engaging member rigidly secured at one end thereof and a second work engaging member slidably carried on the strap for engaging the workpiece. The principles of the invention utilize the elasticity and deformability of the strap to provide the clamping and locking force.

An adjustable clamp using a flexible extension element is disclosed in U.S. Pat. No. 3,076,646, issued Feb. 5, 1963. However, the device of this invention, while using a flexible tension member to apply the clamping force to the faces of a pair of clamp jaws, also requires a reel mounted on a carrier which is reciprocally mounted on a frame. One end of the flexible element is secured to the reel so that it may be wound on the reel while the other end is secured to a clamp jaw. The device does not utilize the ability of a flexible deformable element which, in returning to its original configuration, provides a clamping force, as does applicant.

SUMMARY OF THE INVENTION

A variable force exerting clamp assembly having a variable clamping area in which a flexible, stretchable, deformable band is used to apply a holding force to a workpiece and which uses its ability to return to its original configuration responsive to deformation thereof to apply a locking or clamping force on the workpiece. The device includes a flexible, stretchable, deformable band having a first engaging clamping member secured at one end thereof and a slidable second work engaging clamping member carried thereon. The work engaging clamping members are disposed for retaining a workpiece or workpieces therebetween, and the slidable member is provided with a clamping element is biased relation therewith which exerts a force on the strap as it is deformed because of a tension or stretching force applied thereto. Responsive to release of the tension force, the strap tends to assume its orignal position and applies a frictional force on the movable clamping member for retention thereof in the clamped position.

DESCRIPTION OF THE PREFERRED EMBODIMENT

Figure 1:
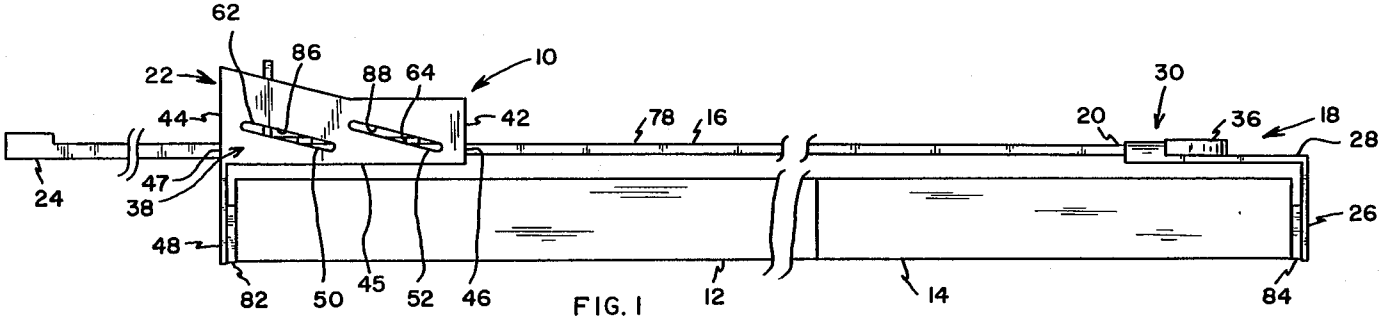
FIG. 1 is an elevational view of the clamping apparatus of the present invention illustrating a stretchable strap having a permanently affixed clamping member at one end thereof and a second clamping member carried on the strap for movable, clamping relation therewith. A pair of elements is shown to be clamped together by the clamping apparatus.

As seen in FIG. 1, a clamping device 10 is positioned to hold a pair of elements 12 and 14 in clamped relation. Clamping assembly 10 includes a stretchable strap 16 having a fixed clamping or work-engaging member 18 rigidly secured to the end 20 thereof and disposed in engaged relation with element 14. A second or movable clamp 22 is slidably mounted on the strap intermediate the distal end 24 and end 20.

Figure 2:
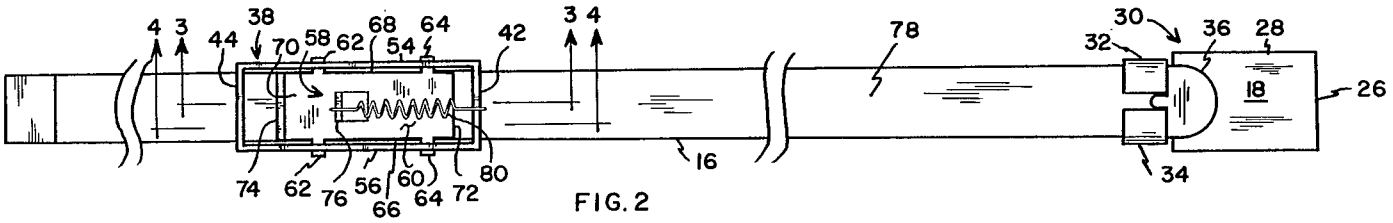
FIG. 2 is a plan view of the clamp assembly of FIG. 1.

The first clamping or work-engaging member 18 includes a downwardly depending work-engaging end portion 26, an intermediate horizontally extending portion 28, and an end 30 which includes a pair of ears 32 and 34 (FIG. 2) disposed in crimped relation adjacent a raised portion 36 of the end 20 of the strap for secured relation between the strap and work-engaging member 18.

Movable clamp assembly 22 includes a frame or retaining member 38 having upstanding forward and rearward ends 42 and 44 and an intermediate horizontal section 45. An opening 46 is provided in end 42 and a similar opening 47 is provided in end 44 through which strap 16 extends, and end 44 further includes a downwardly depending work engaging portion 48. A pair of angled slots 50 and 52 is provided in each side 54 and 56 of member 38.

Figure 5:
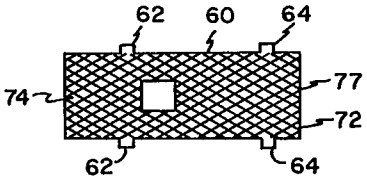
FIG. 5 is a sectional view taken along line 5—5 of FIG. 4 illustrating the bottom textured surface of the frictional clamping member.
Figure 4:
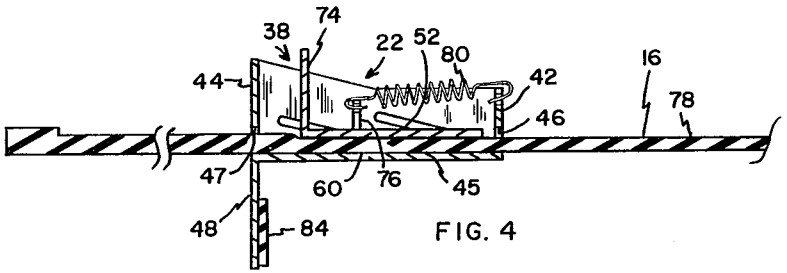
FIG. 4 is a sectional view taken along line 4—4 of FIG. 2 and illustrates the clamp assembly in the clamped position.
Figure 6:
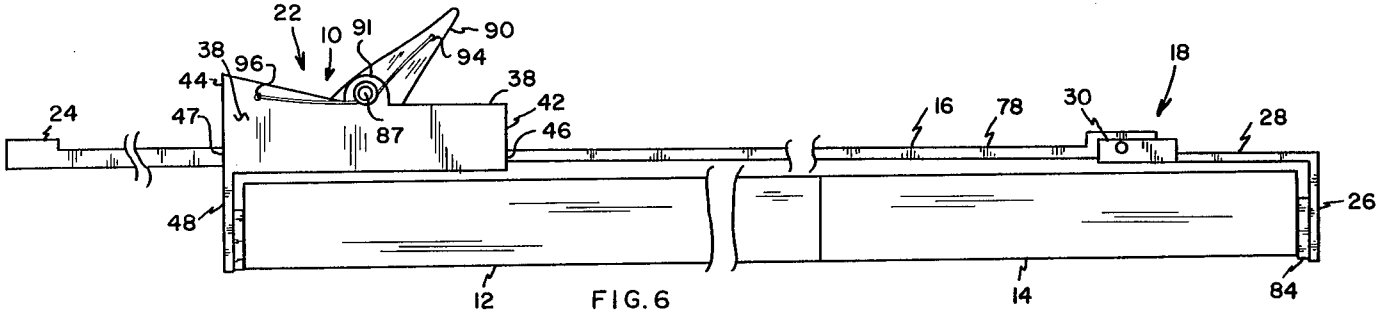
FIG. 6 is an elevational view of an alternate embodiment of the clamp assembly of the present invention.
Figure 7:
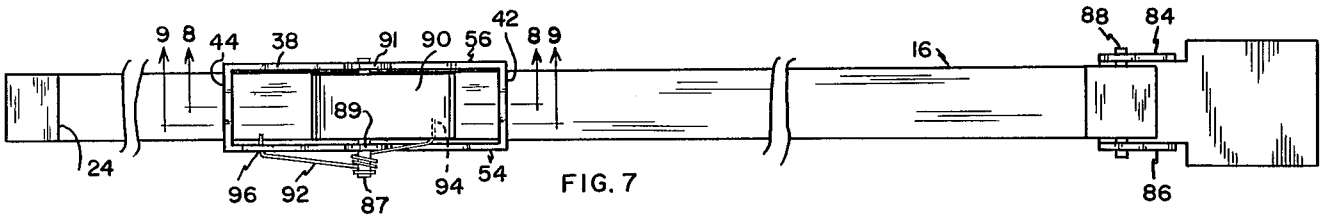
FIG. 7 is a plan view of the clamp assembly of FIG. 6.
Figure 3:
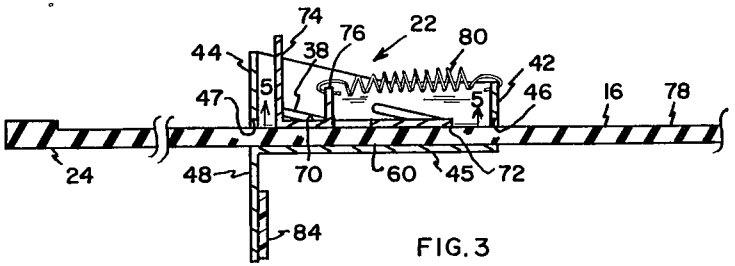
FIG. 3 is a sectional view taken along line 3—3 of FIG. 2 but illustrates the clamping assembly in the unclamped position.
Figure 9:
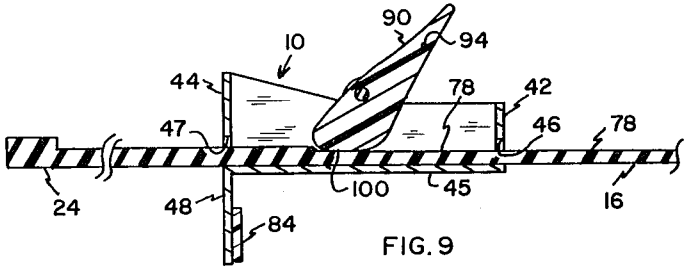
FIG. 9 is a sectional view taken along line 9—9 of FIG. 7 illustrating the clamping assembly in the unclamped position.
Figure 8:
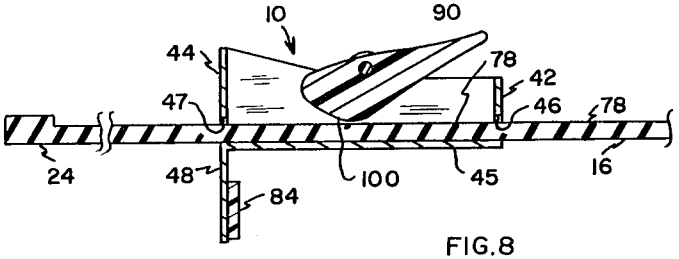
FIG. 8 is a sectional view taken along line 8—8 of FIG. 7 illustrating the clamping assembly in the unclamped position.

To provide the clamping force to the strap, a clamping member 58 (FIG. 2) is slidably mounted in retaining member 38. Clamping member 58 includes a horizontally extending portion 60 having a pair of protrusions or ears 62 and 64 extending from each side 66 and 68 intermediate ends 70 and 72 thereof. The ears extend into the angled slots 50 and 52 of retaining member 38 for slidable movement therein. Member 58 further includes an upstanding portion 74 at the end 70 thereof and a second smaller upstanding portion 76 intermediate ends 70 and 72 of member 58. The underside 77 of horizontally extending portion 60 may be textured (FIG. 5) to increase the gripping relation of member 58 and the upper surface 78 of strap 16 (FIG. 9). A spring 80 is secured in biased relation between end 42 of retaining member 38 and upstanding portion 76 of member 58.

In operation, the elements to be clamped, elements 12 and 14, are brought together and retained between member 18 and clamp assembly 22. It will be noted that the interior surfaces of depending portions 26 and 48 of members 18 and 22 are covered with a protective material 82 and 84, respectively, to prevent marring or scratching of the surfaces of the elements 12 and 14 to be clamped. Once the elements to be clamped are positioned between the clamping members, clamping assembly 22 is held by hand and strap 16 is pulled through openings 46 and 47 until the desired compressive force is reached between the elements to be clamped. As the strap is stretched and lengthened, its thickness is reduced, thus allowing portion 60 of member 58 to move forward and downward, thus reducing the space between horizontal portion 60 of member 58 and member 45 and retaining the strap in its elongated condition between these members. Upon releasing the applied tension to the belt, the underside 77 of the clamping member 58 remains in frictional contact with the upper surface 78 of the strap. The strap, because of its elasticity, tends to assume its previous undeformed configuration and exerts an upward, forward force on the clamping member which forces the ears 62 and 64 upwardly against the upper surfaces 82 and 84 of the slots in binding relation therewith. To release this binding force, the operator merely engages upstanding end 74 of slidable member 58 for rearward movement thereof which moves the member rearwardly and upwardly in grooves 50 and 52 against the bias of the spring to release the engagement between member 58 and strap 16.

FIGS. 6–9 illustrate another embodiment of the present invention wherein like numerals refer to like parts. The clamp assembly 10 includes strap 16 having the fixed, work-engaging member 26 rigidly secured to the end 20 thereof and disposed in engagement with element 14. The second or movable clamp assembly 22 is slidably mounted on the strap intermediate the distal end 24 and end 20.

In this embodiment, work-engaging member 18 includes downwardly depending, work-engaging end portion 26, an intermediate, horizontally extending portion 28, and an end 30 which includes a pair of upstanding sides 84 and 86 disposed in spaced relation. A pin 88 extends through strap 16 and is secured to sides 84 and 86 to secure member 18 to strap 16.

Movable clamp assembly 22 includes frame or retaining member 38 having upstanding forward and rearward ends 42 and 44, respectively. Opening 46 is provided in end 42 and a similar opening 47 is provided in end to receive strap 16. End 44 further includes downwardly depending work-engaging portion 48. A lever 90 is pivotally mounted by a pin 87 which extends between raised arcuate portions 89 and 91 of sides 54 and 56 of retaining member 38. A spring 92 is secured in an opening 94 of lever 90 and in an opening 96 in side 56 of retaining member 38 for biasing the end 98 of lever 90 upwardly and a lower cam surface 100 of lever 90 (FIGS. 8 and 9) downwardly in engagement with the upper surface 78 of strap 16. The surface 100 may be roughened to enhance the gripping force between the lever and the strap.

In the operation of this embodiment, the elements 12 and 14 which are to be clamped are brought together in the manner described above. Once the elements to be clamped are positioned between the clamping members, strap 16 is pulled through the openings 46 and 47 until the desired compressive force is reached between the elements to be clamped. The strap is released and the spring 92 exerts an upward force on end 98 of lever 90, and frictional contact is maintained between upper surface 78 of the strap and surface 100 of lever 90. In attempting to assume its previous undeformed configurtion, the belt tends to swell or enlarge in width which exerts an upward binding force against surface 100 of lever 90. To release this binding force, the operator merely depresses end 98 of lever 90 for disengagement of surface 100 of lever 90 with the strap.

Figure 10:
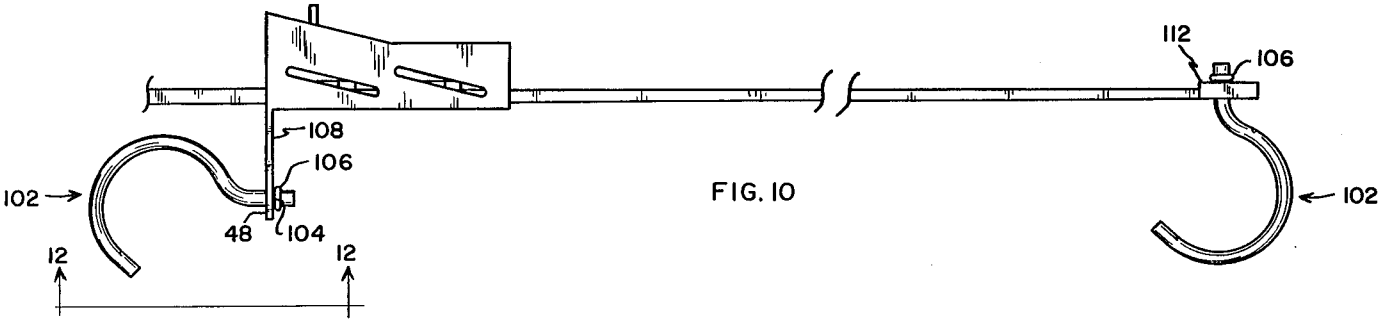
FIGS. 10 and 11 are elevational views of the clamp assembly of the present invention and illustrates a hook arrangement for retaining workpieces in the clamp assembly of the present invention.
Figure 11:
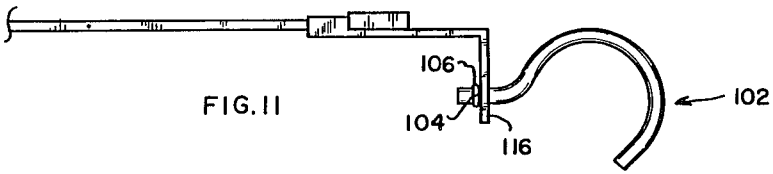
Figure 12:
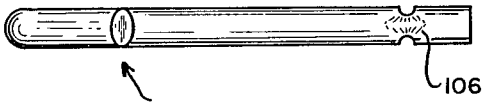
FIG. 12 is an elevational view as seen along line 12—12 of FIG. 10.

FIGS. 10–12 illustrate other types of end clamping members for use with circular or semi-circular members, such as a chair or table legs, etc. As seen in FIG. 10, a hook 102 is secured in an opening 104 of downwardly depending member 48 of retaining member 38. The hook includes a shoulder 106 which engages a back side surface 108 for releasable retention of the hook in the opening. The hook is merely inserted through the opening until shoulder 106 abuts against the surface. As can be further seen in FIGS. 10 and 12, the end member 18 may or may not be used as a clamping member. If desired, as seen in FIG. 10, end member 18 may be replaced by hook 102 which is inserted in an opening 110 at the end 20 of strap 16, with shoulder 106 engaging an upper end surface 112 of the strap. Or, if desired, the hook 102 may be inserted in an opening 114 of downwardly depending member 26 with shoulder 106 abutting an inner surface 116 of member 26.

I claim:

1.A variable force exerting clamp assembly having a variable clamping area comprising:

an elastic stretchable strap;

a first fixed clamping member rigidly secured to a first end of said strap;

a second clamping member disposed in slidable relation on said elastic strap;

frictional clamping means carried by said second clamping member in biased relation therewith and in contactual relation with said strap, said strap disposed for deformation from a first normal configuration to a second, thinner, more elongated configuration responsive to application of a tensional force thereto, and said clamping means disposed for gripped engagement with said strap responsive to said strap returning to said first normal configuration in response to release of said tensional force; and said first and second clamping members disposed for receiving a workpiece therebetween, whereby the distance between said clamping members is defined by the distance said second clamping member is moved along said strap, and the force exerted on said workpiece is determined by the amount of tensional force applied to said strap.

2. A clamp assembly as set forth in claim 1 wherein said second clamping means includes a retaining member having a pair of upstanding spaced ends and a pair of upstanding spaced sides, said ends and said sides forming a cavity, said frictional clamping means mounted in said cavity.

3. A clamp assembly as set forth in claim 2 wherein said ends of said retaining member are provided with an opening therein through which said strap extends.

4. A clamp assembly as set forth in claim 3 wherein said first and second clamping members are provided with clasping means depending therefrom for retention of said workpiece therebetween.

5. A clamp assembly as set forth in claim 4 wherein said frictional clamping means includes a pair of substantially parallel sides having guide means thereon, and said retaining member includes complementary guide means on each said side thereof to receive said guide means of said frictional clamping means.

6. A clamp assembly as set forth in claim 5 wherein said guide means of said frictional clamping means includes a pair of spaced protrusions extending from said sides, and said complementary guide means is a pair of angled slots arranged in spaced relation in each said side of said retaining member, said angled slots having upper surfaces disposed for engaged relation by said protrusions for binding relation therebetween responsive to release of said tensional force on said strap.

7. A clamp assembly as set forth in claim 6 including a spring secured to said forward end of said retaining member and said frictional clamping means for the biased relation thereof.

8. A clamp assembly as set forth in claim 7 wherein said clamping member is provided with a lower textured surface to enhance the frictional contact between said slidable member and said strap.

9. A clamp assembly as set forth in claim 4 wherein said slots are defined by upper and lower spaced surfaces, said upper surface being serrated to enhance the gripping force between said slidable member and said sides of said retaining member.

10. A clamp assembly as set forth in claim 4 wherein said frictional clamping means comprises a lever pivotally mounted in biased relation in said retaining member, said lever including a lower arcuate surface disposed for frictional gripping engagement with the upper surface of said strap.

11. A clamp assembly as set forth in claim 10 wherein said sides of said retaining members each includes a raised arcuate surface having an opening therein, a pin extending between and secured in said openings, said lever mounted on said pin in pivotal relation.

12. A clamp assembly as set forth in claim 11 including a spring mounted in said pin and provided with a first end secured to said lever and a second end secured to said retaining member for the biased relation of said lever in said retaining member.

13. A clamp assembly as set forth in claim 4 wherein said clasping means are arms secured to and extending from said clamping members.

14. A clamp assembly as set forth in claim 13 wherein said clasping means further includes a hook-like member secured to selected arms of said clamping members.

15. A clamp assembly as set forth in claim 4 wherein said clasping means includes a hook-like member secured to said first end of said strap.

* * * * *